US005222802A

United States Patent [19]

Beck

[11] Patent Number: 5,222,802

[45] Date of Patent: Jun. 29, 1993

[54] FLEXIBLE BAG ASSEMBLY

[75] Inventor: B. Joseph Beck, Mason, Ohio

[73] Assignee: The Kenley Corporation, Mason, Ohio

[21] Appl. No.: 831,685

[22] Filed: Feb. 5, 1992

[51] Int. Cl.[5] ..... F21V 1/06

[52] U.S. Cl. ..... 362/156; 362/352; 362/806

[58] Field of Search ..... 362/156, 352, 806

[56] References Cited

U.S. PATENT DOCUMENTS

| | | | |
|---|---|---|---|
| 736,506 | 8/1903 | Duket | 362/806 X |
| 764,207 | 7/1904 | Robinson . | |
| 1,912,960 | 6/1933 | Aki et al. . | |
| 2,149,213 | 3/1917 | Fislar . | |
| 2,936,366 | 9/1958 | Rainford . | |
| 4,167,034 | 9/1979 | Noguchi . | |
| 4,926,296 | 5/1990 | Blume | 362/156 |
| 5,034,868 | 7/1991 | Stelfox et al. . | |
| 5,134,551 | 7/1992 | Stelzer | 362/806 X |

FOREIGN PATENT DOCUMENTS 1284913 12/1968 Fed. Rep. of Germany .

*Primary Examiner*—Allen M. Ostrager
*Attorney, Agent, or Firm*—Frost & Jacobs

[57] ABSTRACT

A flexible, decorative yard bag assembly is internally supported by a lightweight structure having a non-continuous support surface. The bag assembly may include an internal illuminating source to light the bag for display in the dark.

10 Claims, 1 Drawing Sheet

FLEXIBLE BAG ASSEMBLY

TECHNICAL FIELD

The present invention relates generally to flexible bags and is particularly directed to a decorative yard bag of the type typically used to display faces and other designs while supported by a filling material in a non-collapsed condition. The invention will be specifically disclosed in connection with an illuminated translucent bag with a design thereon.

BACKGROUND OF THE INVENTION

In recent years, it has become very popular for home-owners to use decorative plastic bags in their yards. These bags are typically oversized, approximately 52 inches by 60 inches in size, and formed of polyethylene. Decorative indicia, such as stylized faces, are usually displayed on the outside surfaces of the bags. The color of the bags and the specific decorative indicia thereon frequently varies in accordance with the seasons, with certain colors and designs being popular during particular holidays. For example, orange bags with pumpkin face indicia are popular during the Halloween season, while red bags with Santa Claus face graphics are popular during the Christmas season.

Bags of this nature are designed to display the graphics on their sides and to provide yard decoration only when they are supported in an upright, and expanded or non-collapsed condition. However, since they are usually made of thin, flexible polyethylene material, they lack sufficient structural rigidity to be self-supporting. Consequently, it has been necessary in the past to fill the bags with some type of filling material in order to obtain this necessary upright non-collapsed condition. Many times, the filling material used by yard owners for these bags is simply leaves from their own yard. The tendency to use leaves as the filling material is, no doubt, enhanced by the fact that similar bags without decorative graphics are widely used by yard owners for the storage and transport of leaves.

While decorative bags of this type function very efficiently during daylight hours, they are difficult to see in unlighted yards during the evening hours. It is, of course, possible to place spotlights on the decorative yard bags of the prior art, or to use them in illuminated areas. However, in many instances, spotlights and other outside lighting are objectionable because they are not focused exclusively upon the decorative bags, and the light illuminates other areas. Furthermore, light produced by many spotlights and many other types of outdoor lighting is frequently aesthetically harsh to many observers and for this reason objectionable.

SUMMARY OF THE INVENTION

Accordingly, it is a primary object of the present invention to provide a decorative yard bag that can be supported in an upright, non-collapsed condition and be illuminated so as to display decorative graphics on the bag without undue illumination upon surrounding areas.

A related object of the present invention is to provide a decorative yard bag that has localized, controlled illumination.

Another object of the invention is to provide a decorative yard bag with soft, aesthetically acceptable illumination that is not harsh to an observer.

A still further object of the invention is provide a decorative yard bag that is supported in an upright, non-collapsed condition and is internally illuminated.

Yet another object of the invention is to provide a lightweight internal support structure for a decorative bag.

A still further object of the invention is to provide an internal support structure for an internally illuminated decorative yard bag that minimizes attenuation of the transmission of light from the space within the bag to observers located external to the bag.

Additional objects, advantages and other novel features of the invention will be set forth in part in the description that follows and in part will become apparent to those skilled in the art upon examination of the following, or may be learned from the practice of the invention. The objects and advantages of the invention may be realized and obtained by means of the instrumentalities and combinations, particularly pointed out in the appended claims.

To achieve the foregoing and other objects, in accordance with the purposes of the present invention as described herein, improved decorative yard bag is provided. The decorative yard bag is formed of a flexible, collapsible translucent material having design indicia thereon. The bag has at least one opening that is closeable to define an internal space within the bag. A support structure is disposed in the internal space, and the support structure is operative to support the bag in an expanded, non-collapsed condition. Means are provided in the internal space for illuminating the internal space so as to illuminate the bag and to display the design indicia thereon to observers located external to the bag.

In one aspect of the invention, the support structure has a non-continuous external surface in contacting relationship with the internal surface of the bag.

In accordance with another aspect of the invention, the support structure consist of a plurality of individual rod members joined by interposed connectors.

In another aspect of the invention, one of the rod members and connectors is insertable into the other.

In another aspect of the invention, the rods and connectors are formed of translucent material so as to minimize attenuation of light emanating from the illuminating means within the bag.

In a still further independent aspect of the invention, an assembly is provided for displaying designs on a flexible, collapsible bag. The assembly includes a collapsible bag formed of flexible, foldable material with a design indicia thereon. The bag includes at least one opening that is closeable to define an internal space within the bag. A non-inflatable support structure is disposed in the internal space within the bag. The support structure is operative to support the bag in an expanded, non-collapsed condition.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects all without departing from the spirit of the invention. Accordingly, the drawing and descriptions will be regarded as illustrative in nature and not as restrictive.

BRIEF DESCRIPTION OF THE DRAWINGS

The accompanying drawings incorporated in forming a part of the specification illustrates several aspects of the present invention, and together with the description serve to explain the principles of the invention. In the drawings.

DETAILED DESCRIPTION OF THE PREFERRED EMBODIMENT

Reference will now be made to the present preferred embodiment of the invention, an example of which is illustrated in the accompanying drawings, wherein like numbers indicate the same elements throughout the views.

Figure 1:
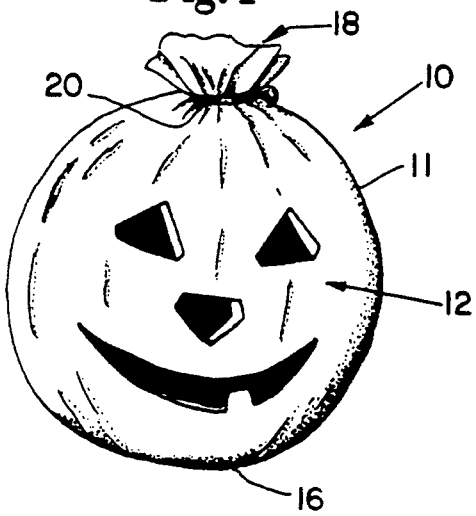
FIG. 1 is a perspective view showing the front external surface of a decorative yard bag with design indicia thereon.

Turning now to the drawings, FIG. 1 shows a perspective view of a decorative yard bag assembly 10 constructed in accordance with the principles of the present invention. The principle part of the assembly 10 shown in FIG. 1 is the bag 11, which bag 11 is preferably an oversize bag, approximately 52 inches by 60 inches in size, formed of low density polyethylene material. The outside surface of the bag 11 contains decorative graphics, shown in the illustrated embodiment as a pumpkin face 12. The bag 11 is sealed at its bottom portion 16 and includes but a single opening 18 in its top portion. The opening 18 is closeable by gathering and compressingly engaging the bag 11 in the area about the opening 18. This compressive engagement of the bag 11 about the opening 18 is accomplished in the illustrated embodiment through the agency of a tie member or string 20.

Figure 2:
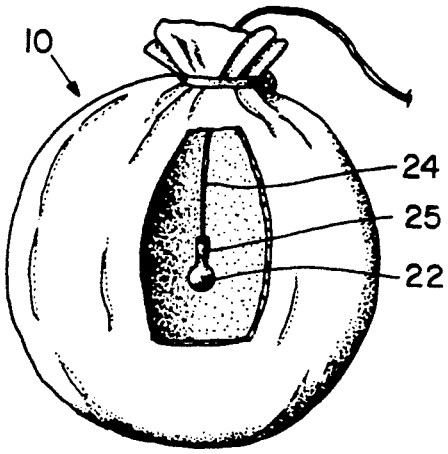
FIG. 2 is a fragmentary perspective view of the back of the decorative yard bag of FIG. 1, showing lines an illuminating source centrally disposed in the internal space defined by the bag.

From the illustration of FIG. 1, the bag assembly 10 appears quite similar to the decorative yard bags of the prior art. However, as will be appreciated from viewing the fragmentary illustration of FIG. 2, the bag assembly 10 has an illuminating source, specifically illustrated as a light bulb 22, centrally disposed in the internal spaced defined by the bag 11. The illuminating source 22 is shown through the removed area of the bag 11 in FIG. 2. The specifically illustrated light bulb 22 is shown suspended in approximately the center of the generally spherical internal space defined by the bag 11. This positioning is achieved in the illustrated embodiment by simply hanging the light bulb from an electrical cord 24 extending through top opening 18 of the bag 11, and securing the cord 24 relative to the bag 11 by compressing the cord 24 and the top of bag 11 gathered about the opening 18, and tightly fastening the string 22 thereabout.

Figure 5:
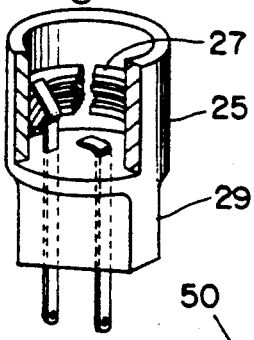
FIG. 5 is an electrical socket used to apply electrical energy to the internal space defined by the decorative bag of FIGS. 1 and 2.

The light bulb 22 is electrically joined to the cord 24 by a combination light socket-plug 25, as more clearly shown in the enlarged illustration of FIG. 5. The combination socket plug 25 has a threaded light bulb socket 27 on its one end and plug portion 29 on its opposite end. The plug portion 29 is readily insertable into the cord 24, which cord 24 may be a simple electrical extension cord.

Figure 3:
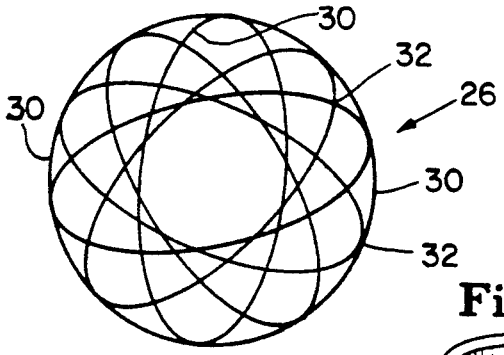
FIG. 3 is a perspective view of a polygon support structure that is disposed inside the decorative bag of FIGS. 1 and 2 and used to support the bag in an upright condition against collapse.

Unlike the decorative bags of this type utilized in the prior art, the bag assembly 10 of the present invention is not filled with leaves or other filling material. Instead, the bag 11 if supported in an upright, non-collapsed condition by an internally disposed polyhedral support structure 26, as shown in FIG. 3. When the polyhedral support structure 26 is positioned within the bag 11, the bag 11 contacts and is supported against collapse by the outside surface of the polyhedral support structure 26, which polyhedral support structure 26 has a generally spherical outside configuration. The center portion of the polyhedral support structure 26 is vacant, which permits adequate space for the light bulb 22.

Also, quite significantly, the outside surface of the polyhedral support structure 26 is non-continuous so that the majority of the internal surfaces of the bag 11 is not in contacting relationship with the polyhedral support. Such a non-continuous surface contact permits a maximum amount of light from the illuminating source 22 to reach, and pass through, the translucent material of the bag 11.

Figure 4:
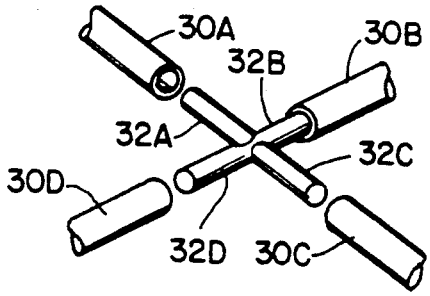
FIG. 4 is an enlarged perspective view of a connector used to join individual tubular members in the construction of the polygon support of FIG. 3.

In the illustrated embodiment, the polyhedral support structure 26 is constructed of a plurality of individual flexible plastic rods, specifically shown as cylindrically shaped tubular members 30 which are joined by a plurality of interposed connectors 32. The end portions of four such tubular members, 30A, 30B, 30C and 30D are depicted in the enlarged view of FIG. 4, where they are interjoined by connector 32. As illustrated in FIG. 4, the illustrated connector 32 is a solid piece of plastic formed of four cylindrically shaped projections 32A, 32B, 32C and 32D. The specifically illustrated projections are coplanar, with adjacent projections being orthogonally oriented with respect to each other. The projections 32A, 32B, 32C and 32D are insertably joined to the respective ends 30A, 30B, 30C and 30D to form the polyhedral 26. Also, in order to maximize the emission of light from the bag 11, the rods 30 and connectors 32 are preferably formed of clear or translucent material. The use of clear or translucent material for these rods 30 and connectors 32 significantly reduces the visibility of the support structure 26 from outside of the bag 11.

Figure 6:
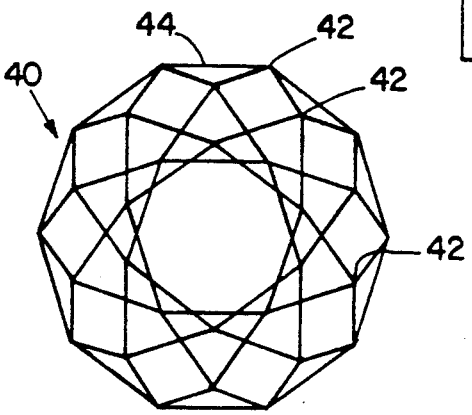
FIG. 6 is an alternative configuration of a polygon support structure that could be used to support the decorative yard bag of FIGS. 1 and 2.
Figure 7:
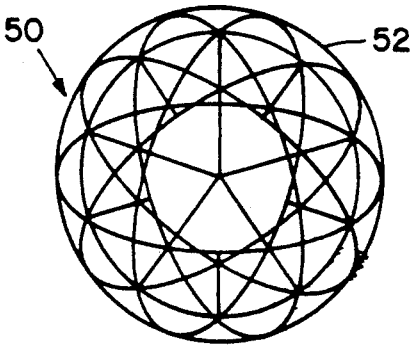
FIG. 7 is another alternative configuration of a polygon support structure that could be used to support the decorative yard bag of FIGS. 1 and 2.

Since the connector 32 illustrated in FIG. 4 utilizes coplanar projections, the generally spherical configuration of the polyhedral support is achieved by arcuately flexing the tubular members 30. Alternative polyhedral supports 40 and 50 are depicted in FIGS. 6 and 7, respectively. Like the polyhedral support in FIG. 3, the supports of FIGS. 6 and 7 are constructed of plastic individual links of plastic tubing joined by connectors. FIG. 6, however, uses connectors 42 with non-planar projections, and non-flexed tubular members 44. While the individual tubular members 44 of FIG. 6 are straight, the overall configuration of the support structure 40 continues to approximate a sphere. FIG. 7, like FIG. 3, employs flexible members 22, and likewise forms a generally spherical configuration with interconnected tubular rods 52.

As will be appreciated from the above description, the invention employs a decorative yard bag with an internally disposed support structure that is designed to permit maximum light flow from a light bulb within the bag through the translucent bag material. In this way, the yard bag of the present invention can be illuminated and viewed during the evening hours. Also, quite significantly, such internal illumination is attentuated by the translucent polyethylene material. As a result, the yard bag transmits only a muted light to outside observers. Furthermore, the light from the decorative bag is generally confined to the bag itself, and does not materially illuminate extraneous areas about the bag.

The support structure aspect of the invention can also be utilized very effectively without the illuminating source, especially in situations where filling material is either unavailable or undesirable. For example, leaves, the commonly used filling material, may be unavailable in particular geographical areas or in certain seasons. Additionally, filling material may be undesirable in certain situations, such as use in in-store displays. The support structure of the invention is also advantageously lightweight. Consequently, the use of the support structure allows uses, such as hanging from a ceiling or other elevated structure, that would be undesirable for a bag containing filling material.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims attended hereto.

I claim:

1. An assembly for illuminating and displaying designs on a flexible, translucent, collapsible bag, comprising:

(a) a collapsible bag formed of flexible, foldable, translucent material and having design indicia thereon, said bag having at least one opening that is flexibly closable to define a closed internal space within the bag;

(b) a removable support structure wholly containable in the internal space within the bag, said opening being flexibly movably to a position permitting insertion and removal of the support structure into and out of the internal space, said support structure being operative to support the external surface of said bag in an expanded, non-collapsed condition; and (c) means located int he internal space within the bag for illuminating the internal space so as to illuminate the bag and display the design indicia to observers located external to the bag.

2. An assembly as recited in claim 1 wherein the support structure has a non-continuous external surface in contacting relationship with the internal surface of the bag.

3. An assembly as recited in claim 2 wherein the support structure consists of a plurality of individual rod members joined by interposed connectors.

4. An assembly as recited in claim 3 wherein one of the rod members and connectors is insertable into the other.

5. An assembly as recited in claim 4 wherein the rods and connectors are formed of translucent material so as to minimize attenuation of light emanating from the illuminating means.

6. An assembly as recited in claim 5 wherein the illuminating means includes an incandescent bulb.

7. An assembly as recited in claim 5 wherein the rods have a generally cylindrical configuration.

8. An assembly as recited in claim 7 wherein the connectors include a plurality of projections adapted to interconnect with the rods.

9. An assembly as recited in claim 8 wherein the projections have a generally cylindrical configuration.

10. An assembly as recited in claim 3 wherein the rods are flexed.

* * * * *

UNITED STATES PATENT AND TRADEMARK OFFICE

CERTIFICATE OF CORRECTION

PATENT NO. : 5,222,802
DATED : June 29, 1993
INVENTOR(S) : B. Joseph Beck

It is certified that error appears in the above-indentified patent and that said Letters Patent is hereby corrected as shown below:

In column 6, line 11, (claim 1), "movably" should read --movable--

In column 6, line 17, (claim 1), "int he" should read --in the--

Signed and Sealed this

Tenth Day of May, 1994

Bruce Lehman

*Attest:*

BRUCE LEHMAN

*Attesting Officer*

*Commissioner of Patents and Trademarks*